United States Patent [19]

Gruber et al.

[11] 4,415,646

[45] Nov. 15, 1983

[54] NITROGEN CONTAINING POLYMERS AS CHARGE ENHANCING ADDITIVE FOR ELECTROPHOTOGRAPHIC TONER

[75] Inventors: Robert J. Gruber, Pittsford; Steven B. Bolte; Doretta Agostine, both of Rochester, all of N.Y.

[73] Assignee: Xerox Corporation, Stamford, Conn.

[21] Appl. No.: 354,472

[22] Filed: Mar. 3, 1982

[51] Int. Cl.[3] ..... G03G 9/00

[52] U.S. Cl. ..... 430/110; 430/115; 430/528

[58] Field of Search ..... 430/110, 528, 115

[56] References Cited

U.S. PATENT DOCUMENTS

| | | | |
|---|---|---|---|
| 3,893,935 | 7/1975 | Jadwin | 252/62.1 |
| 3,944,493 | 3/1976 | Jadwin et al. | 252/62.1 |
| 3,970,571 | 7/1976 | Olson et al. | 430/110 X |
| 3,985,664 | 10/1976 | Sakaguchi et al. | 252/62.1 |
| 4,055,684 | 10/1977 | Baltazzi et al. | 430/120 |
| 4,071,655 | 1/1978 | Brana et al. | 430/104 X |
| 4,079,014 | 3/1978 | Burness et al. | 252/62.1 |
| 4,221,856 | 9/1980 | Lu | 430/110 |
| 4,298,672 | 11/1981 | Lu | 430/108 |
| 4,299,898 | 11/1981 | Williams et al. | 430/106 |

FOREIGN PATENT DOCUMENTS

| | | | |
|---|---|---|---|
| 1382260 | 1/1975 | United Kingdom | 430/110 |
| 1536514 | 12/1978 | United Kingdom . | |
| 2036353 | 6/1980 | United Kingdom | 430/110 |

*Primary Examiner*—John D. Welsh
*Attorney, Agent, or Firm*—E. O. Palazzo

[57] ABSTRACT

This invention is directed to positively charged developer compositions and toner compositions, the toner composition being comprised of resin particles, pigment particles, and from about 0.1 to about 10 percent by weight of the toner particles of a polymeric charge enhancing additive selected from the group consisting of those additives of the following formulas:

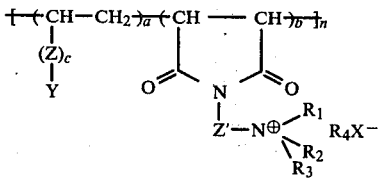

and

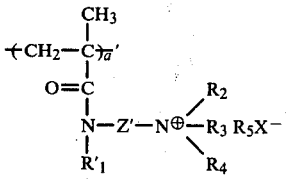

wherein a and b are percentage numbers equaling 100, a being from about 20 weight percent to about 99 weight percent, and b being from about 80 weight percent to about 1 weight percent, n is a repeating number ranging from about 3 to about 300, Z is an oxygen atom, c is the number zero or 1, Y is an alkyl or aromatic radical, Z' is selected from the group consisting of aliphatic, aromatic, and heterocyclic radicals, $R_1$, $R_2$, $R_3$ and $R_4$ are independently selected from alkyl radicals containing from about 1 to about 22 carbon atoms, X is an anion, a' is a number of from about 50 to about 500, $R_1'$ is hydrogen or an alkyl radical containing from 1 to about 22 carbon atoms; as well as methods of developing electrostatographic images utilizing such compositions.

35 Claims, No Drawings

NITROGEN CONTAINING POLYMERS AS CHARGE ENHANCING ADDITIVE FOR ELECTROPHOTOGRAPHIC TONER

BACKGROUND OF THE INVENTION

This invention is generally directed to toner and developer compositions which are useful in electrostatograhic imaging systems. More specifically, the present invention is directed to toner and developer compositions containing polymeric charge enhancing additives, which additives function as charge control materials, and impart a positive charge to the toner composition. Additionally the use of these polymeric additives in developer compositions increases the admix charging rate of new uncharged toner particles added to charged developer compositions comprised of toner and carrier particles, present for example in a xerographic imaging apparatus. Furthermore, the polymeric charge enhancing additives of the present invention control the magnitude of the charge on the toner particles. Toners and developers containing the polymeric additives of the present invention are particularly useful in electrostatographic copying devices employing Viton fuser systems as more specifically detailed hereinafter.

The electrostatographic process and more specifically, the xerographic process is well known, as documented in several prior art references. In these processes, an electrostatic latent image is developed by applying toner particles to the image, using, for example, cascade development, magnetic brush development, or touchdown development. In some instances, it may be desirable in these systems to obtain a reverse copy from a positive original, or a positive copy from a negative original. This can be accomplished by modifying the charging relationships between the toner and the carrier particles, utilizing, for example, charge enhancing additives.

In U.S. Pat. No. 3,893,935, there is disclosed the use of quaternary ammonium salts as charge control agents for electrostatic toner compositions. According to the disclosure of this patent, certain quaternary ammonium salts when incorporated into toner materials were found to provide a toner composition which exhibited relatively high uniform and stable net toner charge, when mixed with a suitable carrier. U.S. Pat. No. 4,079,014 contains a similar teaching with the exception that a different charge control agent is used, namely a diazo type compound.

There is also described in copending applications, and U.S. Pat. No. 4,298,672, charge enhancing additives, which are not only useful for imparting a positive charge to the toner resin, but also allow rapid admix of uncharged toner particles. One problem associated with some of these charge enhancing additives is that they have a tendency to adversely affect Viton coated fuser rolls, that is, toners containing such additives can react with the Viton coatings causing the rolls to malfunction, and thus result in inefficient fusing. Also, there is disclosed in the referred to copending applications and U.S. Patent, charge control additives that differ significantly from the polymeric additives of the present invention.

Additionally, several of the prior art developer compositions which contain charge enhancing additives have a tendency to lose their positive charge over a periof of time, and in some instances, the additives are incompatible with the thermoplastic toner resin, thus creating difficulties in achieving a uniform dispersion of such materials in the toner composition. Furthermore, when new uncharged replenishment toner particles are added to charged developer compositions the new particles do not acquire the desired positive charge until a substantial period of time has elapsed, and it is important in order to constantly obtain good quality images, as well as for other purposes, that the newly added toner particles rapidly acquire the appropriate positive charge. This is referred to as admix charging.

Accordingly there continues to be a need for positively charged toners and developers which will allow the production of high quality images over extended time periods. Additionally, there is a need for improved charge enhancing additives, which when added to toners and developers control the toner charge and admix rate of newly added uncharged toner particles. Further there is a need for toners and developers containing charge control additives that do not adversely affect certain fuser rolls, such as Viton coated fuser rolls used in xerographic imaging systems. Additionally, there continues to be a need for new charge enhancing additives.

SUMMARY OF THE INVENTION

It is a feature of the present invention to provide toner compositions and developer compositions which overcome the above-noted disadvantages.

A further feature of the present invention is to provide developer compositions containing positively charged toner particles, carrier particles, and certain polymeric charge enhancing additives.

Another feature of the present invention is the provision of developer compositions which contain positively charged toner particles having improved toner admix charging, improved humidity insensitivity, while simultaneously being compatible with Viton coated fuser devices.

A further feature of the present invention is the provision of toners and developers which will develop electrostatic images containing negative charges on the imaging surface, and which will transfer effectively electrostatically from such a surface to plain bond paper without causing blurring, or adversely affecting the quality of the resulting image; particularly when such toners and developers are employed in xerographic imaging systems containing a Viton coated furser roll.

A further feature of the present invention is the provision of polymeric charge enhancing materials which are non-reactive with Viton coated fuser rolls.

These and other features of the present invention are accomplished by providing developer compositions containing positively charged toner particles and carrier particles; and by providing dry positively charged toner compositions containing resin particles, pigment particles, and a polymeric charge control or charge enhancing additive of the following formula:

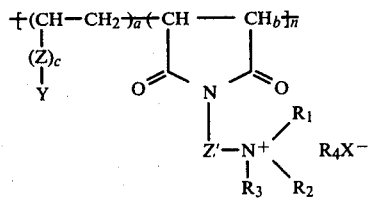

wherein a and b are percentage numbers equaling 100, a being from about 20 weight percent to about 99 weight percent, and b being from about 80 weight percent to about 1 weight percent, n is a repeating number ranging from about 3 to about 300, and preferably from about 6 to about 150, Z is an oxygen atom, c is the number zero or 1, Y is an alkyl or aromatic radical, Z' is selected from the group consisting of aliphatic, preferably alkyl and alkenyl; aromtic, preferably phenyl, and heterocyclic radicals, $R_1$, $R_2$, $R_3$ and $R_4$ are independently selected from the group consisting of alkyl radicals containing from about 1 to about 22 carbon atoms, and substituted alkyl radicals, wherein the substitutents include halogen materials, and X is an anion such as a halide, a nitrate, a sulfide, a sulfate, a sulfonate, or tosylate, and the like. Preferred charge enhancing additives include those materials wherein $R_1$, $R_2$, $R_3$, and $R_4$ are methyl, Z' and Y are alkyl radicals, and the anion X is a sulfate radical, a halogen, or a tosylate radical.

Illustrative examples of alkyl radicals include for example methyl, ethyl, propyl, butyl, pentyl, hexyl, octyl, nonyl, decyl, myristyl, cetyl, olely, pentadecyl, heptadecyl, stearyl, and the like. The preferred alkyl radicals contain from 1 to about 6 carbon atoms, including as for example methyl, ethyl, propyl and butyl. Examples of aromatic radicals include phenyl and naphthyl, which radicals can be substituted with alkyl groups such as methyl, ethyl, propyl, and the like. Halogen substituents include chloride, bromide, and fluoride, with chloride being preferred. Heterocyclic radicals include those containing nitrogen in the ring, such as pyridine, quinoline, and the like.

Generally, the polymeric charge enhancing additives of the present invention result from the condensation reaction of maleic anhydride polymers, with certain alkyl diamines, followed by quaternizing the resulting product.

Illustrative examples of maleic anhydride polymers useful for forming the polymeric charge enhancing additives of the present invention include for example:

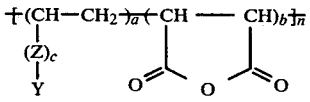

wherein a, b, n, c, Z and Y are as defined herein.

Illustrative examples of preferred maleic anhydride polymers embraced within the above formula and useful for forming the polymeric charge enhancing additives of the present invention include poly(styrene-co-maleic anhydride) commercially available from ARCO Chemical Company as SMA-1000, and SMA-3000; poly(octadecene-1-co-maleic anhydride) commercially available from Gulf Oil Chemical Company, as PA-18; and poly(octadecyl vinylether-co-maleic anhydride) commercially available from GAF Corporation as Gantrez 8194.

Illustrative examples of preferred alkyl diamines which can be reacted with the maleic anhydride polymer include N,N-dimethyl-1,3-propanediamine, N,N-dimethyl-1,2-ethylene diamine, 4-aminopyridine, and 4-amino-N,N-dimethylbenzylamine.

Subsequent to the condensation reaction between the maleic anhydride polymer and the alkyl diamine, quaternization is accomplished as known in the art, thereby resulting in the formation of the polymeric charge enhancing additives of the present invention.

In one typical reaction sequence, the polymeric charge enhancing additives of the present invention are obtained in accordance with the following reaction sequence.

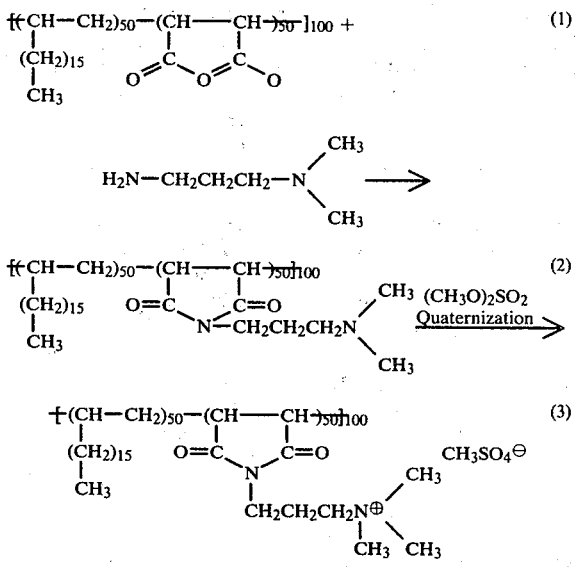

The polymeric charge control additives of the present invention can be incorporated into toner compositions and developer compositions in various amounts provided there results toner particles that are charged positively in comparison to the carrier particles, and providing that such amounts do not adversely effect the development properties of the carrier and toner particles. Thus for example, the amount of polymeric charge control additive utilized ranges from about 0.1 percent by weight to 10 percent by weight based on the weight of toner particles, and preferably from about 0.5 weight percent to about 5 weight percent by weight. In one preferred embodiment, the polymeric charge control additive is present in an amount of from about 0.75 weight percent to about 5 weight percent primarily because better charge admixing is obtained with such amounts. The polymeric charge enhancing additive of the present invention can be blended into the toner composition or such additive may be coated on the pigment particles, such as carbon black. When the polymeric charge control additive is employed as a coating it is present in an amount of from about 2 weight percent to about 20 weight percent, and preferably from about 5 weight percent to about 10 weight percent, based on the weight of the pigment particles.

Toners and developers containing the polymeric charge control additives of the present invention, rapidly charge new uncharged toner particles being added as replenishment material to the developer composition. As indicated hereinbefore, this is known as rapid admix charging. By admix charging is meant providing the appropriate charges, for example, in the present invention, positive charges, at a rapid rate to new uncharged toner particles, or replenishment toner being added to the charged developer composition. As is customary in xerographic imaging systems fresh toner particles must be added as toner is being consumed for the development of images. In some situations in the past, the new uncharged toner being added did not achieve the desired charge level until a significant period of time had elapsed, for example after 12 to 15 minutes, or longer. This time delay can adversely effect the developer composition in that high quality images would not result in many instances until the new uncharged toner particles had acquired the appropriate electrical charge level, and the desired polarity.

When the polymeric charge enhancing additives of the present invention are contained in the developer composition, the rate at which uncharged toner particles acquire positive charge, is, in many instances, substantially less than 15 minutes. Thus, for example, in some instances, the uncharged toner particles become suitably charged in less than 10 minutes. Such rapid admix charging allows the developer composition to achieve charge stability within a shorter period of time, in comparison to some prior art compositions. Therefore, with such developer compositions better quality images are obtained with substantially no background.

As indicated herein, many of the prior art charge control agents interact with certain fuser roll compositions used in electrostatographic systems, such as Viton coated fuser rolls, which causes such rolls to be adversely affected, resulting in a deterioration of image quality. For example, the Viton coated fuser rolls may discolor and harden, and develop multiple surface cracks when some of the prior art charging control additives are employed in the toner mixture. One such Viton coated fuser roll used in electrostatographic copying machines, particularly xerographic devices, is comprised of a soft roll fabricated from lead oxide, and DuPont Viton E-430 resin, a vinylidene fluoride hexafluoropropylene copolymer. Approximately 15 parts of lead oxide, and 100 parts of the Viton E-430 are blended together, and curred on a roll at elevated temperatures. Excellent image quality has been obtained with the use of such Viton coated fuser rolls, however, in some instances there can be a toner developer-fuser compatibility problem when charge control additives are present. It appears that certain charge control additives, such as quaternary ammonium compounds and alkyl pyridinium compounds, react with the Viton coating. For example, alkyl pyridinium chloride, such as cetyl pyridinium chloride when part of the toner mixture can cause the formation of highly substantially crosslinked unsaturated compounds. As a result of this, the Viton coated fuser roll assumes and undesirable black color, hardens, and develops a multiple number of surface cracks, which factors cause the image quality to deteriorate. In contrast, the polymeric charge control additives of the present invention are compatible with Vitor fuser rolls.

Numerous methods may be employed to produce the toner composition of the present invention. One method involves melt blending the resin particles and the pigment particles coated with the polymeric charge control additives, followed by mechanical attrition. Other methods include those well known in the art such as melt dispersion, dispersion polymerization, and the like.

Illustrative examples of resins utilized in the present invention include polyamides, epoxies, polyurethanes, vinyl resins and polyesters, especially those prepared from dicarboxylic acids and diols comprising diphenols. Various suitable vinyl resins may be employed including homopolymers or copolymers of two or more vinyl monomers. Typical of such vinyl monomeric units include: styrene, p-chlorostyrene, vinyl naphthalene, ethylenically unsaturated mono-olefins such as ethylene, propylene, butylene, isobutylene and the like; and olefins such as butadiene, vinyl halides such as vinyl chloride, vinyl bromide, vinyl fluoride, vinyl esters such as vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

Generally toner resins containing a relatively high percentage of styrene are preferred. The styrene resin employed may be a homopolymer of styrene, or styrene homologs of copolymers of styrene with other monomeric groups. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques, such as free radical, anionic, and cationic polymerization processes. Any of these vinyl resins may be blended with one or more resins if desired, preferably other vinyl resins, which insure good triboelectric properties, and uniform resistance against physical degradation. However, non-vinyl type thermoplastic resins may also be employed, including resin modified phenolformaldehyde resins, oil modified epoxy resins, polyurethane resins, cellulosic resins, polyether resins, and mixtures thereof.

Further esterification products of a dicarboxylic acid, and a diol comprising a diphenol may be used as a preferred resin material in the toner composition of the present invention. These materials are illustrated in U.S. Pat. No. 3,655,374, the disclosure of which is totally incorporated herein by reference, the diphenol reactant being of the formula as shown in column 4, beginning at line 5 of this patent, and the dicarboxylic acid being of the formula as shown in column 6 of the above patent.

Illustrative examples of pigment particles or dyes that may be utilized are well known, and include for example, carbon black, nigrosine dye, aniline blue, mixtures thereof, and the like. The pigment or dye should be present in the toner composition in sufficient quantity to render it highly colored, in order that such a composition will form a clearly visible image on the recording member. For example, where conventional xerographic copies of documents are desired, the toner contains a black pigment, such as carbon black. Preferably, the pigment particles are present in amounts of from about 3 percent to about 20 percent by weight, based on the total weight of toner particles.

Various suitable carrier materials can be employed, providing they are capable of triboelectrically obtaining a charge of opposite polarity to that of the toner particles. In the present invention thus, the carrier particles are negatively charged in order that the positively charged toner particles can adhere to, and surround the carrier particles. Examples of carrier particles include steel, nickel, iron ferrites, silicon dioxide and the like, with metallic carriers, especially magnetic carriers being preferred. The carriers can be used with or without a coating. The coatings generally contain polyvinyl fluoride resins, but other resins especially those which charge negatively, such as polystyrene, halogen containing ethylenes, and the like can be used. Many of the typical carriers that can be used are described in U.S. Pat. Nos. 2,638,522; 3,591,503; 3,533,835; and 3,526,533. Also nickel berry carriers, as described in U.S. Pat. Nos. 3,847,604 and 3,767,598 can be employed, these carriers being nodular carrier beads of nickel, characterized by a surface of reoccurring recesses, and protrusions, providing particles with a relatively large external area. The diameter of the coated carrier particle is from about 50 to about 1,000 microns, thus allowing the carrier to possess sufficient density and inertia to avoid adherence to the electrostatic images during the development process.

The carrier may be employed with the toner composition in any suitable combination, however, best results are obtained when there is present from about 1 part to 3 parts by weight of toner particles, with from about 10 to about 100 parts by weight of carrier particles.

Toner compositions of the present invention may be used to develop electrostatic latent images on various suitable imaging surfaces capable of retaining charge including conventional photoconductors, however, the toners of the present invention are best utilized in systems wherein a negative charge resides on the imaging surface, and this usually occurs with organic photoresponsive members. Illustrative examples of such members include polyvinyl carbazole, 4-dimethylaminobenzylidene, benzhydrazide, 2-benzylidene-amino-carbazole, (2-nitro-benzylidene)p-bromoaniline, 2,4-diphenyl-quinazoline, 1,2,4-triazine, 1,5-diphenyl-3-methyl pyrazoline 2-(4'-dimethyl-amino phenyl)-benzoxazole, overcoated photoreceptor devices containing generating layers and transport layers, particularly those comprised of a substrate, overcoated with a photogenerating layer, such as vanadyl phthalocyanine or trigonal selenium, which in turn is overcoated with a charge transport layer containing a diamine, as described in U.S. Pat. No. 4,265,990, the disclosure of which is totally incorporated herein by reference; as well as overcoated photoreceptor devices comprised of a substrate, a hole injecting material, a hole transport layer, a generating layer, and a top layer of an organic insulating resin, as described in U.S. Pat. No. 4,251,612, the disclosure of which is totally incorporated herein by reference.

Also embraced within the present invention are magnetic toner compositions comprised of the toner resins previously indicated, a magnetic pigment, such as Mapico black, and the polymeric charge enhancing additive of the present invention. The magnetic pigment is generally present in an amount of from about 10 weight percent, to about 70 weight percent, and preferably from about 20 weight percent, to about 50 weight percent, based upon the weight of the toner particles.

In another embodiment the present invention is directed to toner and developer compositions, containing polymeric charge enhancing amides of the following formula:

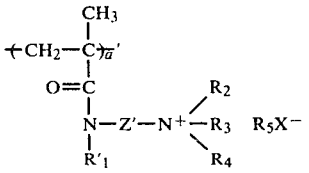

wherein a' is a number of from about 50 to about 500, $R_1'$ is hydrogen or an alkyl radical containing from about 1 to about 22 carbon atoms, $R_2$, $R_3$, $R_4$ and $R_5$ are independently selected from the group consisting of alkyl radicals containing from about 1 to about 20 carbon atoms, and substituted alkyl radicals, Z' is an aliphatic, aromatic or heterocyclic radical as defined hereinbefore, and X is an anion as defined herein including halide, nitrite, sulfide, sulfate sulfonate or tosylate.

Additionally in another embodiment the present invention is directed to a method of developing images utilizing developer compositions containing the polymeric charge enhancing additive illustrated herein; which method involves forming an electrostatic latent image on a suitable photoresponsive device, contacting the resulting image with a developr composition comprised of positively charged toner particles, negatively charged carrier particles, and the polymeric charge enhancing additives disclosed herein, followed by transferring the developed image to a substrate, and subsequently permanently affixing the image thereto. These developer compositions are especially useful in imaging systems employing Viton fuser rolls.

The following examples are being supplied to further illustrate various embodiments of the present invention, it being noted that these examples are intended to illustrate and not limit the scope of the present invention. Parts and percentages are by weight unless otherwise indicated.

EXAMPLE I

There was prepared by melt blending followed by mechanical attrition, a toner composition comprising 89 percent by weight of a copolymer of styrene n-butylmethacrylate, (58 percent by weight of styrene, and 42 percent by weight of n-butylmethacrylate), 6 percent by weight of Regal 330 carbon black, commercially available from Cabot Corporation, and 5 percent by weight of the polymeric charge enhancing additive of the following formula

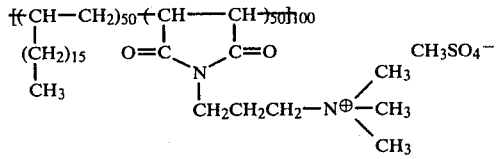

a poly(octadecene-1-co-maleimide-propyl-3-N,N-trimethylammoniummethylsulfate), which toner was micronized to 12 microns volume average diameter.

A developer mixture was prepared by mixing for about 25 minutes 2 parts by weight of the above toner composition, with 100 parts by weight of a carrier consisting of a ferrite core, 100 microns in diameter, coated with 1.2 percent by weight of a fluorinated copolymer of trifluorochloroethylene, and vinylchloride, commercially available from Hooker Chemical Company, as FPC-461.

When uncharged toner particles comprised of 89 percent by weight of a styrene n-butylmethacrylate copolymer resin (58/42) and 11 percent by weight of carbon black are added to the above prepared developer mixture, the admix charging rate was less than about 1 minute, and the new uncharged toner particles acquired a charge of 1 femtocoulomb per gram (fc/g) in less than one minute. The amount of charge acquired, and the time within which it was acquired was measured on a toner charge spectrograph. This instrument disperses toner particles in proportion to the charge diameter, and with the aid of automated microscopy can generate charge distribution histograms or curves for selected toner size classes. Use of the spectrograph allows the monitoring of admix toner charging rates. Charge distribution time sequences can thus be used to distinguish between slow and rapid admix charging rates.

When the above developer mixture contained uncharged toner particles is utilized in the xerographic imaging system wherein the photoreceptor is comprised of a trigonal selenium generating layer, in contact with the amine transport layer N-N'-diphenyl-N'-bis(3-methyl phenyl)-[1,1'-biphenyl]-4,4' diamine, which photoreceptor is prepared as disclosed in U.S. Pat. No. 4,265,990 and is charged negatively, there is immediately obtained after one imaging cycle, images of high quality and excellent resolution, indicating that the new uncharged toner particle rapidly acquired the appropriate level of charge in less than one minute.

EXAMPLE 1A

The charge enhancing additive of Example I was prepared in the following manner. In a three liter flask equipped with a reflux condensor, mechanical stirrer, thermometer, dropping funnel, and heating mantle was placed 150 grams of poly(octadecene-co-maleicanhydride) polymer, commercially available from Gulf Oil Chemical Company as PA18, dissolved in 1 liter of xylene. The resulting solution was heated to a temperature of 110° to 115° C., and maintained at this temperature, while 43.5 grams of N,N-dimethylaminopropylamine, commercially available from Aldrich Chemical Corporation, was added drop wise over a period of 4 hours. Heating was continued subsequent to addition for another 24 hours. On cooling to room temperature there was added with stirring 1 liter of methanol. The resulting polymer was isolated and dried at 60° C. under reduced pressure resulting in 160 grams of an off-white solid polymer. Analysis calculated for $C_{27}H_{50}N_2O_2$: C, 74.60, H, 11.59; N, 6.44. Found: C, 74.62; H, 11.13; and N, 6.22.

Into a 3 liter flask equipped with a mechanical stirrer was placed 150 grams of the above polymer dissolved in 300 milliliters of tetrahydrofurane. To this solution at room temperature was added 75 grams of dimethyl sulfate over a period of 1.5 hours. Upon completion of the dimethylsulfate addition, 2,000 milliliters of acetone was added to the mixture. The precipitated product was collected by filtration, dried under a vacuum at 60° C., resulting in 150 grams of a white solid of the charge enhancing additive of the formula illustrated in Example I.

Analysis calculated for $C_{29}H_{56}N_2O_6S$: C, 61.10; H, 10.06; N, 5.00; S, 5.72. Found: C, 62.52; H, 10.13; N, 4.58; and S, 5.48.

EXAMPLE II

The following polymeric charge enhancing additives were prepared in accordance with Example IA by reacting the appropriate anhydride containing polymer, with the appropriate alkyl diamine, followed by quaternizing the resulting product.

I.

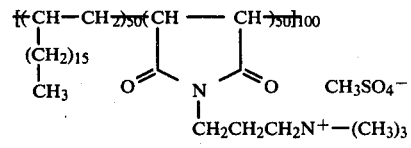

II.

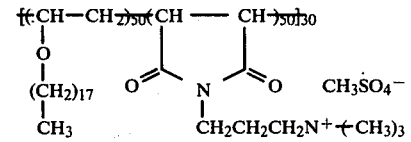

III.

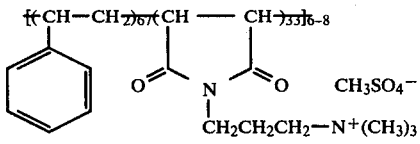

IV.

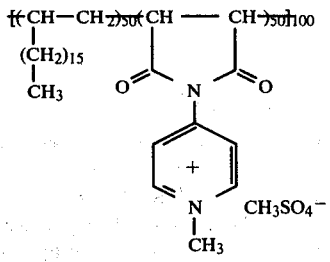

V.

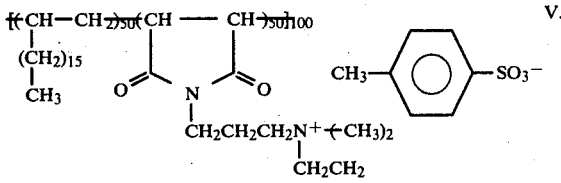

EXAMPLE III

There was prepared the polymeric charge control additive of the following formula:

VI.

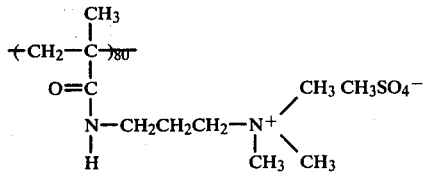

by heating 10 grams of poly(dimethylaminopropylmethacrylamide) dissolved in 100 milliliters of acetonitrile, in a 500 milliliter flask equipped with a reflux. To this was added 16.9 grams of 1-chlorohexadecane, and the resulting reaction mixture was heated to reflux for 48 hours. The mixture was cooled to room temperature, resulting in precipitate of a white solid. The solid was removed by filtration, washed with hexane, and dried resulting in 13 grams of the polymeric control material of the above formula as identified by chemical analysis. Analysis calculated for $C_{25}H_{51}N_2O$: C, 69.65; H, 11.92; Cl, 8.22; N, 6.50. Found: C, 69.69; H, 11.62; Cl, 6.36; N, 6.66.

In a similar manner, the following polymeric charge enhancing additives were prepared:

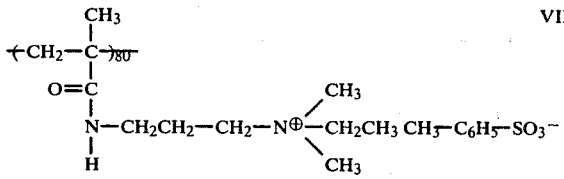

VII.

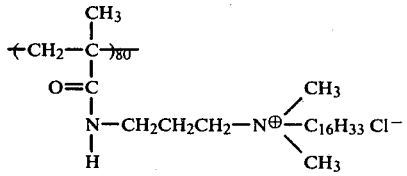

VIII.

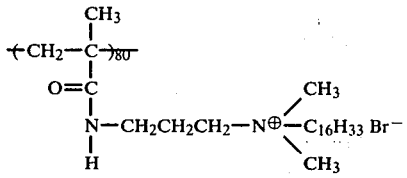

IX.

EXAMPLE IV

The following charge enhancing additives, were formulated into developer compositions in accordance with Example I and possess the following characteristics. Also included in Tables I and II are characteristics of developer compositions not containing polymeric charge control materials.

TABLE I

| Polymeric Imides | | | | | |
|---|---|---|---|---|---|
| Charge Control Material | Conc % | Toner Resin | Charge Femtocoulombs per gram (fc/g) | Admix Time (min) | Carrier Material |
| None | — | a styrene butadiene resin (Goodyear Pliolite S5A) | 1.4 | 15 | Ferrite core coated with a copolymer of trifluorochloroethylene, and vinyl chloride (FPC 461) |
| None | — | a styrene butadiene resin (Goodyear Pliolite S5A) | not** measurable | not measurable | Ferrite core coated with polyvinylidene fluoride (Kynar) |
| None | — | a styrene-n-butylmethacrylate resin (58/42) | 1.4 | 15 | FPC 461 |
| None | — | a styrene-n-butylmethacrylate resin (58/42) | not measurable | not measurable | Kynar |
| None | — | a polyester resin (bisphenol A & fumaric acid) | .2 | 15 | FPC 461 |

TABLE I-continued

| Polymeric Imides | | | | | |
|---|---|---|---|---|---|
| Charge Control Material | Conc % | Toner Resin | Charge Femtocoulombs per gram (fc/g) | Admix Time (min) | Carrier Material |
| I* | 2 | a styrene butadiene resin (Goodyear Pliolite (S5A) | 2.5 | 10 | FPC 461 |
| I | 5 | a styrene butadiene resin (Goodyear Pliolite (S5A) | 2.8 | 10 | Kynar |
| I | 5 | a styrene butadiene resin (Goodyear Pliolite S5A) | 1.8 | 1 | FPC 461 |
| I | 5 | a styrene n-butylmethacrylate resin (58/42) | 1.2 | 2 | FPC 461 |
| I | 2 | a polyester resin (bisphenol A & fumaric acid) | 1.5 | 10 | FPC 461 |
| I | 2 | a polyester resin (bisphenol A & fumaric acid) | 1.5 | 15 | Kynar |
| II | 5 | a styrene butadiene resin (Goodyear Pliolite S5A) | 1.1 | 2 | FPC 461 |
| II | 5 | a styrene n-butylymethacrylate resin (58/42) | 1.3 | 1 | Kynar |
| III | 5 | a styrene butadiene resin (Goodyear Pliolite S5A) | 2.1 | 10 | FPC 461 |
| III | 5 | a styrene butadiene resin (Goodyear Pliolite S5A) | .98 | 5 | Kynar |
| IV | 5 | a styrene butadiene resin (Goodyear Pliolite S5A) | 1.2 | 10 | FPC 461 |
| V | 5 | a styrene butadiene resin (Goodyear Pliolite S5A) | 1.4 | 15 | FPC 461 |

*Represents the polymeric charge control additive identified herein by number indicated.
**Value too low for accurate measurement.

TABLE II

| Polyacrylamide Derivatives | | | | | |
|---|---|---|---|---|---|
| Charge Control Material | Conc. % | Toner Resin | Charge fc/g | Admix Time (min) | Carrier Material |
| None | — | a styrene butadiene resin (Good- | 1.4 | 15 | FPC 461 |

TABLE II-continued

| Charge Control Material | Conc. % | Polyacrylamide Derivatives Toner Resin | Charge fc/g | Admix Time (min) | Carrier Material |
|---|---|---|---|---|---|
| | | year Pliolite S5A) | | | |
| None | — | a styrene-n-butylmethacrylate resin (58/42) | 1.4 | 15 | FPC 461 |
| None | — | a styrene-butadiene resin (Goodyear Pliolite S5A) | 1.5 | 1.5 | Kynar |
| VI | 2 | a styrene butadiene resin (Goodyear Pliolite S5A) | 1.1 | 5 | Kynar |
| VI | 2 | a styrene butadiene resin (Goodyear Pliolite S5A) | 1.4 | 10 | FPC 461 |
| VII | 2 | a styrene butadiene resin (Goodyear Pliolite S5A) | 1.2 | 15 | FPC 461 |
| VII | 2 | a styrene-n-butylmethacrylate resin (58/42) | 1.2 | 5 | FPC 461 |
| VIII | 2 | a styrene butadiene resin (Goodyear Pliolite S5A) | 2.0 | 5 | FPC 461 |
| VIII | 2 | a styrene-n-butylmethacrylate resin (58/42) | 2.1 | 5 | FPC 461 |
| IX | 2 | a styrene butadiene resin (Goodyear Pliolite S5A) | 1.5 | 10 | FPC 461 |
| IX | 2 | a styrene-n-butylmethacrylate resin (58/42) | 1.5 | 1 | FPC 461 |

EXAMPLE V

Developer compositions were prepared in accordance with Example I by mixing together 5 weight percent of each of the polymeric charge enhancing additives listed in Tables I and II with a composition containing 89 percent by weight of a styrene-n-butylmethacrylate copolymer, (58/42), and 6 percent by weight of carbon black, and a carrier component consisting of a ferrite core coated with a copolymer of trifluorochloroethylene and vinylchloride (FPC 461).

Each of the developer compositions of Example V when utilized to develop images in a xerographic imaging system employing the negatively charged overcoated photoreceptor of Example I and a Viton coated fuser roll, resulted in images of excellent quality and high resolution. Further, after 1,000 imaging cycles, with each developer composition, the Viton coated fuser roll did not discolor and was not damaged.

EXAMPLE VI

There was prepared a toner composition in accordance with Example I with the exception that the polymeric charge control additive was not present. Thus, there was prepared by melt blending, a toner composition comprised of 89 percent by weight of a styrene-n-butylmethacrylate copolymer resin, 58 percent by weight of styrene, 42 percent by weight of n-butylmethacrylate, and 11 percent by weight of Regal 330 carbon black commercially available from Cabot Corporation, which toner was micronized to 12 microns volume average diameter. A developer mixture was then prepared by mixing for about 25 minutes, 2 parts by weight of the above toner composition with 100 parts by weight of a carrier material consisting of a ferrite core, 100 microns in diameter, coated with 1.2 percent by weight of a fluorinated copolymer of trifluorochloroethylene and vinylchloride, commercially available from Firestone Company (FPC 461).

When uncharged toner particles comprised of 89 percent by weight of a styrene-n-butylmethacrylate copolymer resin (58/42) and 11 parts by weight of Regal 330 carbon black were added to the above prepared developer mixture, the admix charging rate was 15 minutes, that is, the new uncharged toner particles acquired a charge of 0.1 femtocoulombs per gram in 15 minutes. The amount of charge acquired and the amount of time within which it was acquired was measured on a toner charge spectrograph as accomplished in accordance with Example I.

Also when the above developer mixture containing recently added uncharged toner particles, comprised of 89 percent by weight of a styrene-n-butylmethacrylate copolymer resin (58/42), and 11 percent by weight of Regal 330 carbon black is used to develop images in a xerographic imaging system with the photoreceptor device of Example I, images of low quality and poor resolution are obtained for about 15 minutes, which copy quality begins to improve after 15 minutes, indicating that the uncharged toner particles have not acquired the appropriate level of charge until after 15 minutes.

In another comparison test, a fuser roll coated with Viton E430 resin filled with lead oxide, was coated with the polymeric charge control additives I–V. Fuser rolls containing such polymeric charge enhancing control agents, together with the same coated fuser rolls containing the charge enhancing additive cetylpyridinium chloride and tetrabutylammonium chloride were heated to 400° F. for 24 hours, under identical conditions.

After heating, the condition of the fusing rolls was observed, and the fusing rolls containing the non-polymeric charge control agents, cetylpyridinium chloride and tetrabutylammonium chloride had turned black, and the surface of such rolls were very hard causing surface cracks to appear. In comparison, the Viton coated fuser rolls containing the polymeric charge control additives of the present invention I–IV, had no discoloration, and such rolls were not hardened and did not possess surface craks.

EXAMPLE VII

There is prepared a magnetic toner composition comprised of 50 percent by weight of a polyester resin, consisting of the reaction product of bisphenol A and fumaric acid, 48 percent by weight of the magnetite Mapico black, and 2 percent by weight of the charge enhancing additive of Example I.

Similar imaging results are obtained when the toner of this example is mixed with the carrier material of Example I, and employed to develop images using the overcoated photoreceptor of Example I.

Other modifications of the present invention may occur to those skilled in the art upon a reading of the present disclosure. These are intended to be included within the scope of the present invention.

We claim:

1. A positively charged toner composition comprised of resin particles, and pigment particles, and from about 0.1 to about 10 percent by weight of the toner composition, a polymeric charge enhancing additive selected from the group consisting of those additives of the following formulas:

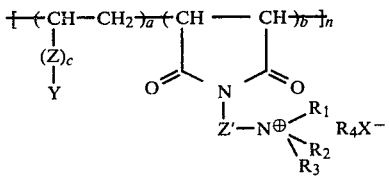

and

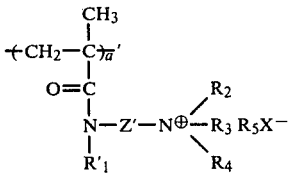

wherein a and b are percentage numbers equaling 100, a being from about 20 weight percent to about 99 weight percent, and b being from about 80 weight percent to about 1 weight percent, n is a repeating number ranging from about 3 to about 300, Z is an oxygen atom, c is the number zero or 1, Y is an alkyl or aromatic radical, Z' is selected from the group consisting of aliphatic, aromatic, and heterocyclic radicals, $R_1$, $R_2$, $R_3$ and $R_4$ are independently selected from alkyl radicals containing from about 1 to about 22 carbon atoms, X is an anion, a' is a number of from about 50 to about 500, $R_1'$ is hydrogen or an alkyl radical containing from 1 to about 22 carbon atoms.

2. A composition in accordance with claim 1, further including carrier particles.

3. A positively charged toner composition comprised of resin particles, and pigment particles, and from about 0.1 to about 10 percent by weight of the toner composition, a polymeric charge control additive of the following formula:

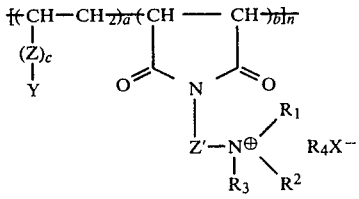

wherein a and b are percentage numbers equaling 100, a being from about 20 weight percent to about 99 weight percent, and b being from about 80 weight percent to about 1 weight percent, n is a repeating number ranging from about 3 to about 300, Z is an oxygen atom, c is the number zero or 1, Y is an alkyl or aromatic radical, Z' is selected from the group consisting of aliphatic, aromatic, and heterocyclic radicals, $R_1$, $R_2$, $R_3$ and $R_4$ are independently selected from alkyl radicals containing from about 1 to about 22 carbon atoms, and X is an anion.

4. A toner composition in accordance with claim 3 further including carrier particles.

5. A composition in accordance with claim 4 wherein the carrier is comprised of a core coated with polyvinylidene fluoride, or a copolymer of trifluorochloroethylene and vinyl chloride.

6. A composition in accordance with claims 3 or 4 wherein $R_1$, $R_2$, $R_3$ and $R_4$ are methyl, c is zero, Z' is propylene, Y is methyl or phenyl, a is 95 weight percent, b is 5 weight percent, n is a repeating number of from about 6 to about 150 and X is a sulfate radical.

7. A composition in accordance with claims 3 or 4 wherein X is a halogen.

8. A composition in accordance with claim 7 wherein the halogen is chloride or fluoride.

9. A composition in accordance with claim 3 wherein X is a sulfonate.

10. A composition in accordance with claim 3 wherein X is a sulfate.

11. A composition in accordance with claim 3 wherein X is a tosylate.

12. A composition in accordance with claim 3 wherein the number n is from about 60 to about 150.

13. A composition in accordance with claim 3 wherein the charge enhancing additive is of the formula:

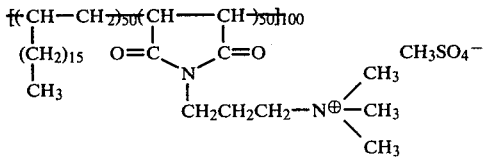

14. A composition in accordance with claim 3 wherein the charge enhancing additive is of the formula:

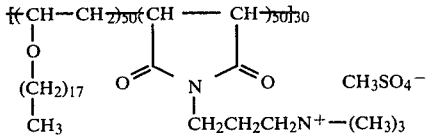

15. A composition in accordance with claim 3 wherein the charge enhancing additive is of the formula:

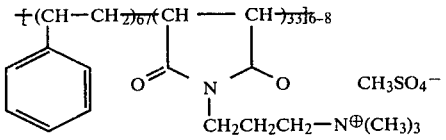

16. A composition in accordance with claim 3 wherein the charge enhancing additive is of the formula:

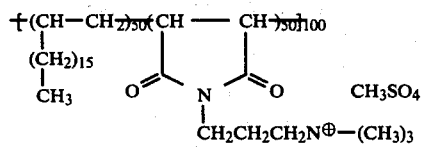

17. A composition in accordance with claim 1 wherein the charge enhancing additive is of the formula:

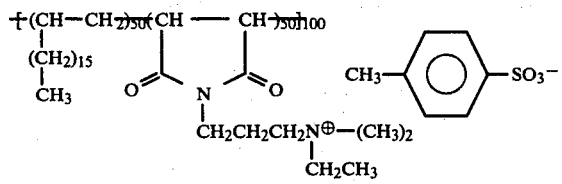

18. A positively charged toner composition comprised of resin particles, and pigment particles, and from about 0.1 to about 10 percent by weight of the toner composition, a polymeric charge enhancing additive of the following formula:

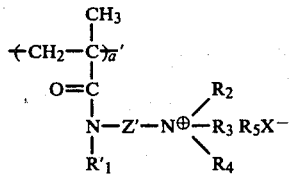

wherein a' is a number of from about 50 to about 500, $R_1'$ is hydrogen or an alkyl radical containing from 1 to about 22 carbon atoms, $R_2$, $R_3$, $R_4$ and $R_5$ are independently selected from alkyl radicals containing from 1 to about 22 carbon atoms, Z' is an aliphatic, aromatic or heterocyclic radical, and X is an anion.

19. A composition in accordance with claim 18 wherein the charge enhancing additive is of the formula:

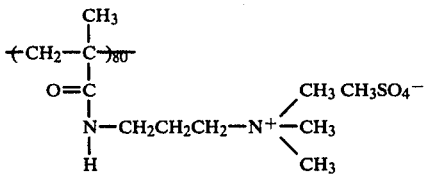

20. A composition in accordance with claim 18 wherein the charge enhancing additive is of the formula:

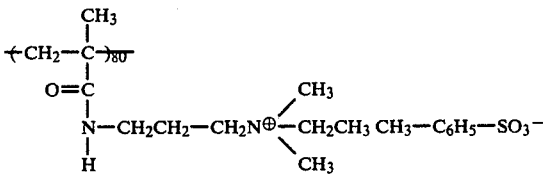

21. A composition in accordance with claim 18 wherein the charge enhancing additive is of the formula:

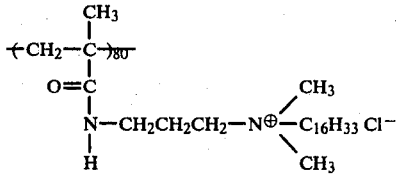

22. A composition in accordance with claim 18 wherein the charge enhancing additive is of the formula:

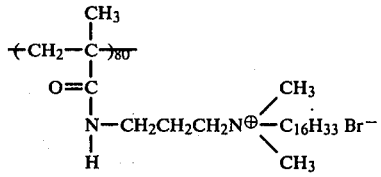

23. A composition in accordance with claim 18 wherein the resin particles are comprised of a is a styrene/n-butylmethacrylate copolymer, a styrene butadiene copolymer, or a polyester, and the pigment particles are comprised of carbon black.

24. A composition in accordance with claim 18 further including carrier particles.

25. A composition in accordance with claim 24 wherein the carrier particles consist of a ferrite core coated with a copolymer of trifluorochloroethylene and vinylchloride, or coated with a polyvinylidene fluoride resin.

26. A method of imaging comprising forming a negative electrostatic latent image on an imaging member, contacting the image with a positively charged dry developer composition comprised of resin particles, pigment particles, carrier particles and from about 0.1 to about 10 weight percent of a polymeric charge enhancing additive selected from the group consisting of those additives of the following formulas:

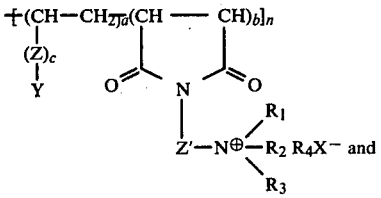

and

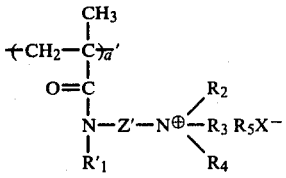

wherein a and b are percentage numbers equaling 100, a being from about 20 weight percent to about 99 weight percent, and b being from about 80 weight percent to about 1 weight percent, n is a repeating number ranging from about 3 to about 300, Z is an oxygen atom, c is the number zero or 1, Y is an alkyl or aromatic radical, Z' is selected from the group consisting of aliphatic, aromatic, and heterocyclic radicals, $R_1$, $R_2$, $R_3$ and $R_4$ are independently selected from alkyl radicals containing from about 1 to about 22 carbon atoms, X is an anion, a' is a number of from about 50 to about 500, $R_1'$ is hydrogen or an alkyl radical containing from 1 to abut 22 carbon atoms, followed by transferring the developed image to a suitable substrate and permanently affixing thereto.

27. A method of imaging in accordance with claim 26 wherein the polymeric charge enhancing additive is of the formula

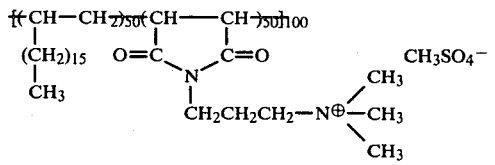

28. A method of imaging in accordance with claim 26 wherein the polymeric charge enhancing additive is of the formula:

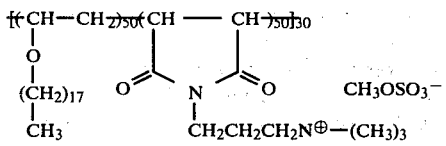

29. A method of imaging in accordance with claim 26 wherein the polymeric charge enhancing additive is of the formula

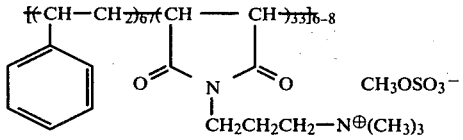

30. A method of imaging in accordance with claim 26 wherein the polymeric charge enhancing additive is of the formula

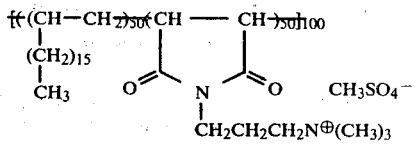

31. A method of imaging in accordance with claim 26 wherein the polymeric charge enhancing additive is of the formula:

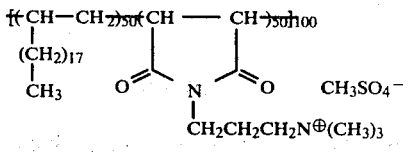

32. A method of imaging in accordance with claim 26 wherein the polymeric charge enhancing additive is of the formula:

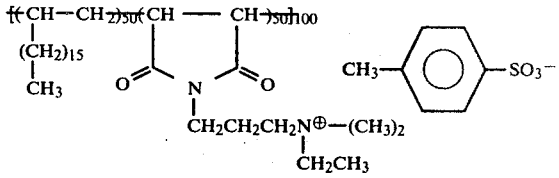

33. A method of imaging in accordance with claim 26 wherein the image is permanently affixed to a paper substrate by employing a fuser roll comprised of lead oxide coated with a vinylidene fluoride hexafluoropropylene copolymer.

34. A method of imaging in accordance with claim 26 wherein the anion x is halogen, sulfite, sulfonate, or tosylate.

35. A method of imaging in accordance with claim 34 wherein the halogen is chloride or fluoride.

* * * * *